US010597858B2

(12) United States Patent
Kang et al.

(10) Patent No.: US 10,597,858 B2
(45) Date of Patent: Mar. 24, 2020

(54) LAMP MODULE AND BIDET DEVICE INCLUDING SAME

(71) Applicant: COWAY CO., LTD., Chungcheongnam-do (KR)

(72) Inventors: Hee-Ju Kang, Seoul (KR); Sung-Worl Jin, Seoul (KR); Da-Woon Jung, Seoul (KR)

(73) Assignee: COWAY CO., LTD., Chungcheongnam-do (KR)

( * ) Notice: Subject to any disclaimer, the term of this patent is extended or adjusted under 35 U.S.C. 154(b) by 62 days.

(21) Appl. No.: 15/773,210

(22) PCT Filed: Oct. 19, 2016

(86) PCT No.: PCT/KR2016/011731

§ 371 (c)(1),
(2) Date: May 3, 2018

(87) PCT Pub. No.: WO2017/078298

PCT Pub. Date: May 11, 2017

(65) Prior Publication Data

US 2018/0320354 A1 Nov. 8, 2018

(30) Foreign Application Priority Data

Nov. 4, 2015 (KR) ..... 10-2015-0154557

(51) Int. Cl.

| | |
|---|---|
| ***E03D 9/08*** | (2006.01) |
| ***F21V 15/01*** | (2006.01) |
| ***F21V 3/02*** | (2006.01) |
| ***F21V 27/02*** | (2006.01) |
| ***F21V 33/00*** | (2006.01) |
| ***F21V 29/506*** | (2015.01) |

(52) U.S. Cl.

CPC ..... *E03D 9/08* (2013.01); *F21V 3/02* (2013.01); *F21V 15/01* (2013.01); *F21V 27/02* (2013.01); *F21V 29/506* (2015.01); *F21V 33/004* (2013.01)

(58) Field of Classification Search

CPC ..... E03D 9/08
USPC ..... 4/443–448
See application file for complete search history.

(56) References Cited

FOREIGN PATENT DOCUMENTS

| | | |
|---|---|---|
| JP | 2001280702 | 10/2001 |
| JP | 2008138423 | 6/2008 |
| KR | 0410526 | 3/2006 |
| KR | 20060119496 | 11/2006 |
| KR | 1044047 | 6/2011 |

OTHER PUBLICATIONS

International Search Report for PCT/KR2016/011731 dated Jan. 18, 2017, 4 pages.

*Primary Examiner* — Lori L Baker
(74) *Attorney, Agent, or Firm* — Dority & Manning, P.A.

(57) ABSTRACT

A lamp module according to an embodiment of the present invention comprises: a lamp having electrode terminals at both ends thereof; a bracket portion including first and second brackets coupled to both ends of the lamp so that the electrode terminals of the lamp are supported; and a cover glass having the lamp and the bracket portion inserted and coupled therein, and having a cavity such that one surface of the bracket is externally exposed, wherein the first bracket may be provided with a communication portion for communicating the inside and the outside of the cover glass.

11 Claims, 11 Drawing Sheets

[FIG.1]
(a)
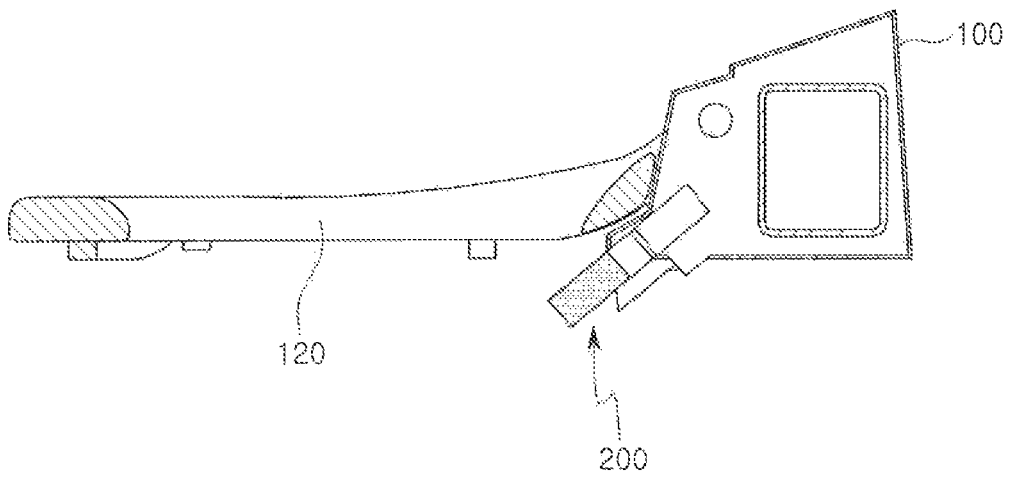
(b)
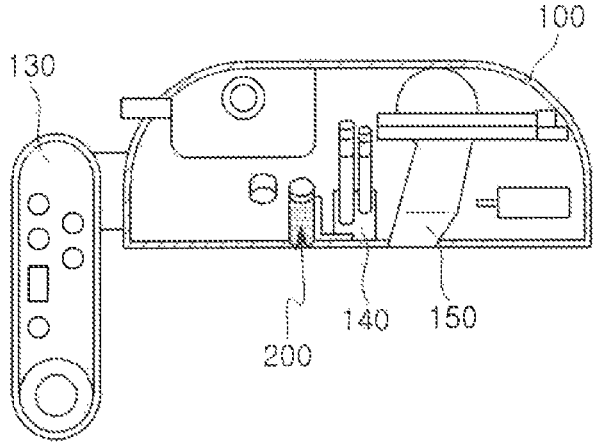

[FIG.2a]
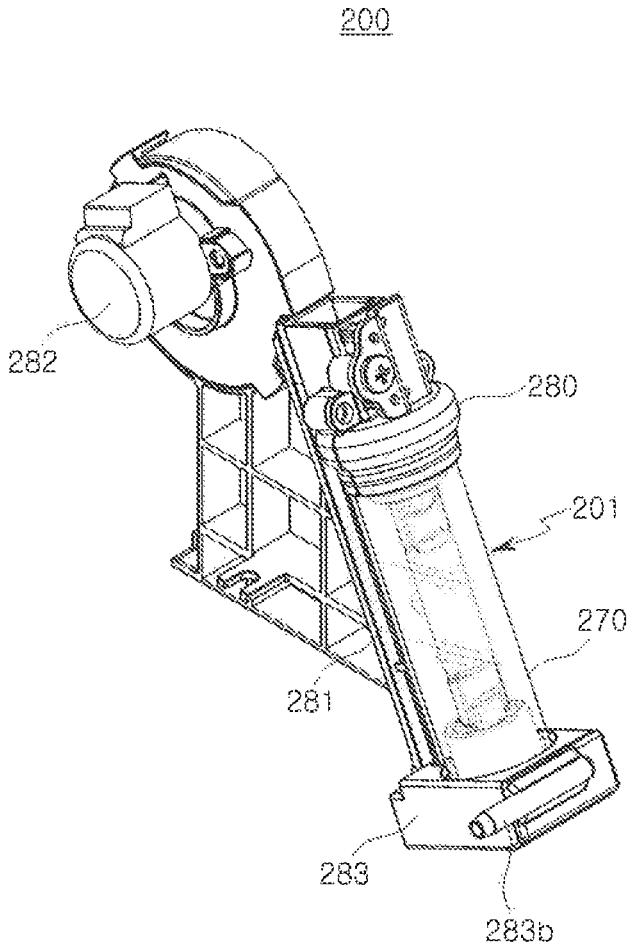

[FIG.2b]
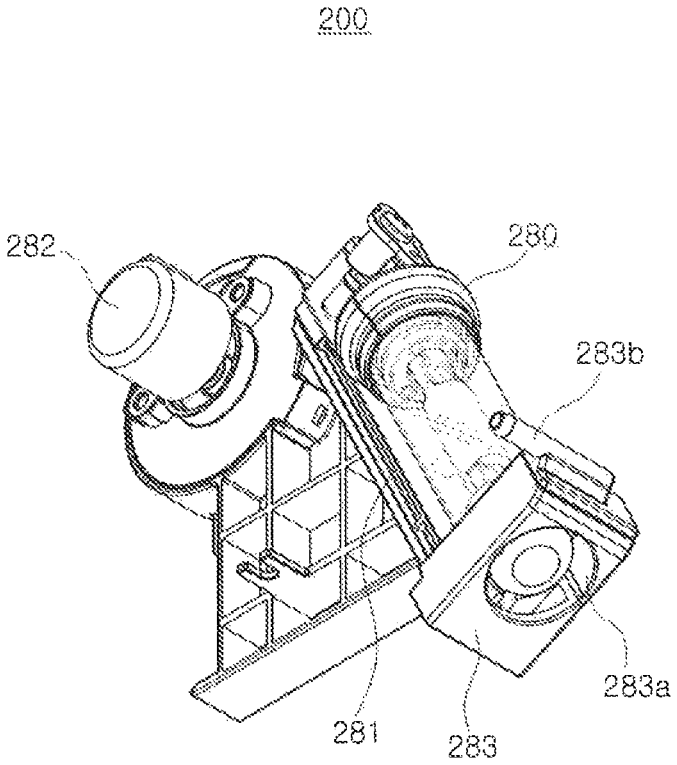

[FIG.3]
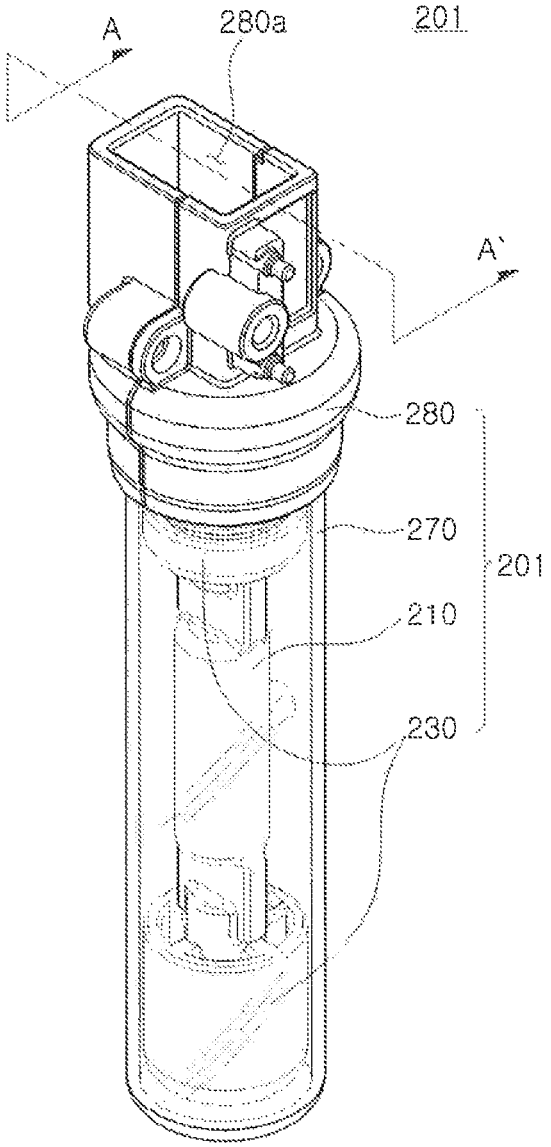

[FIG. 4]
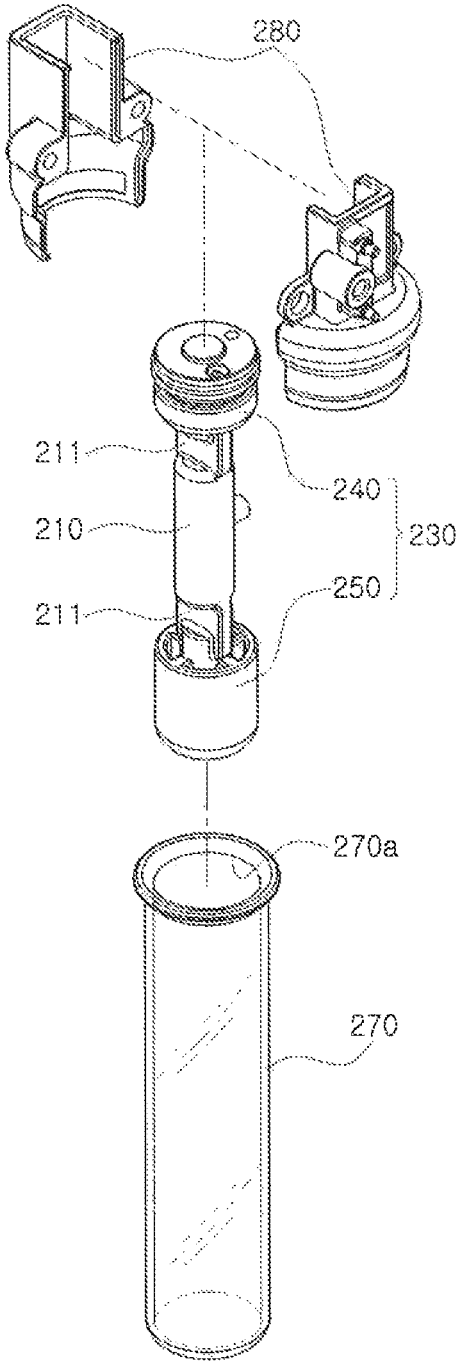

[FIG.5]
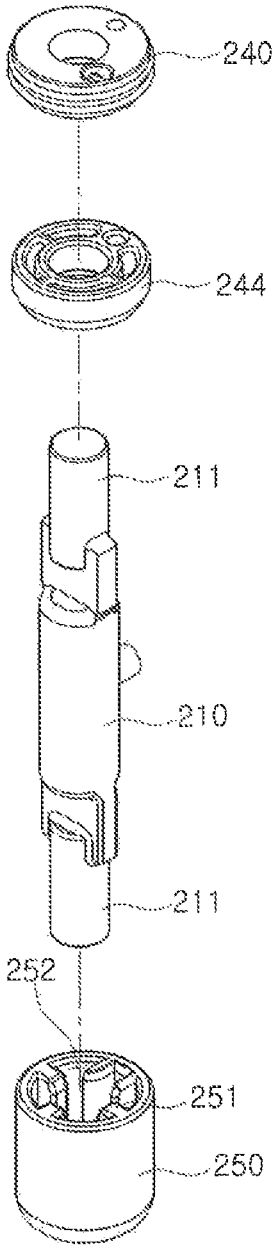

[FIG.6]
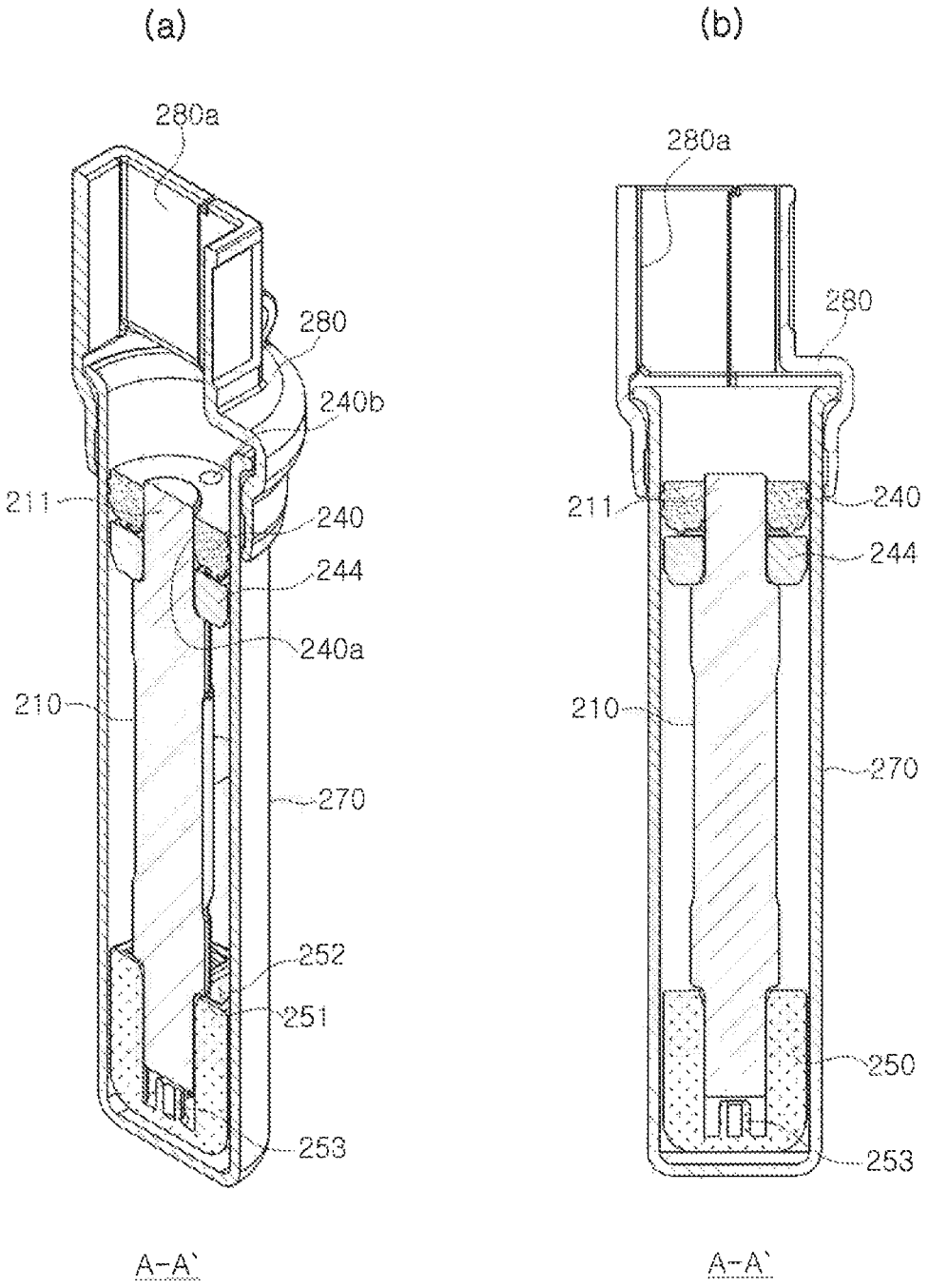

[FIG.7]
(a)
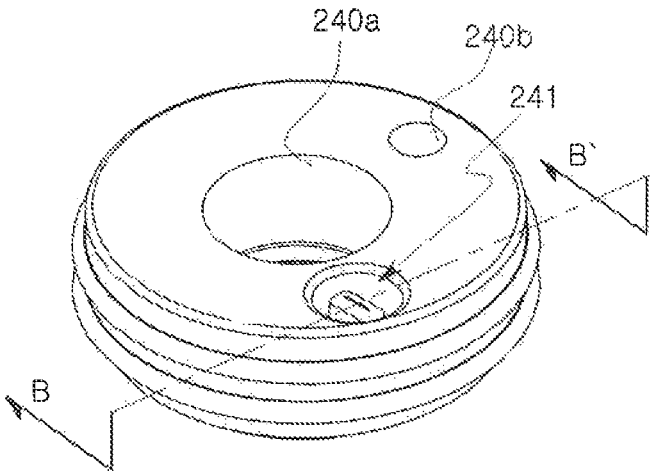
(b)
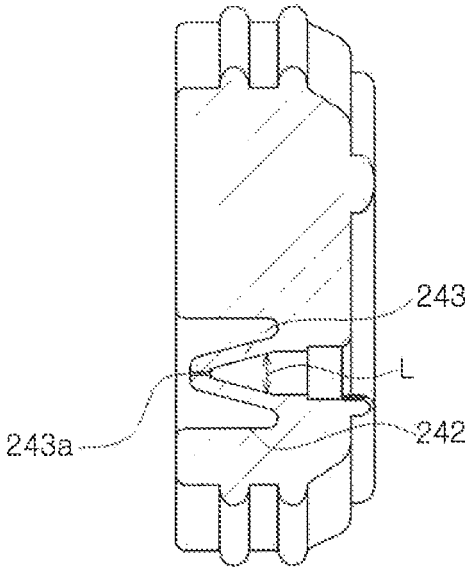
B-B`

[FIG.8]
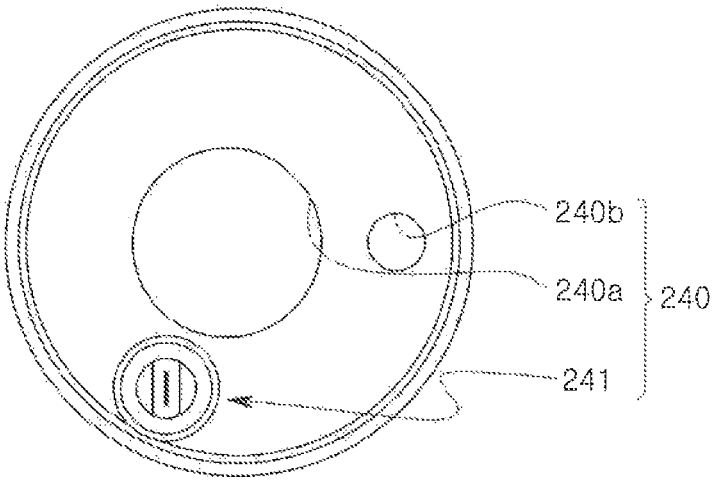

[FIG.9]
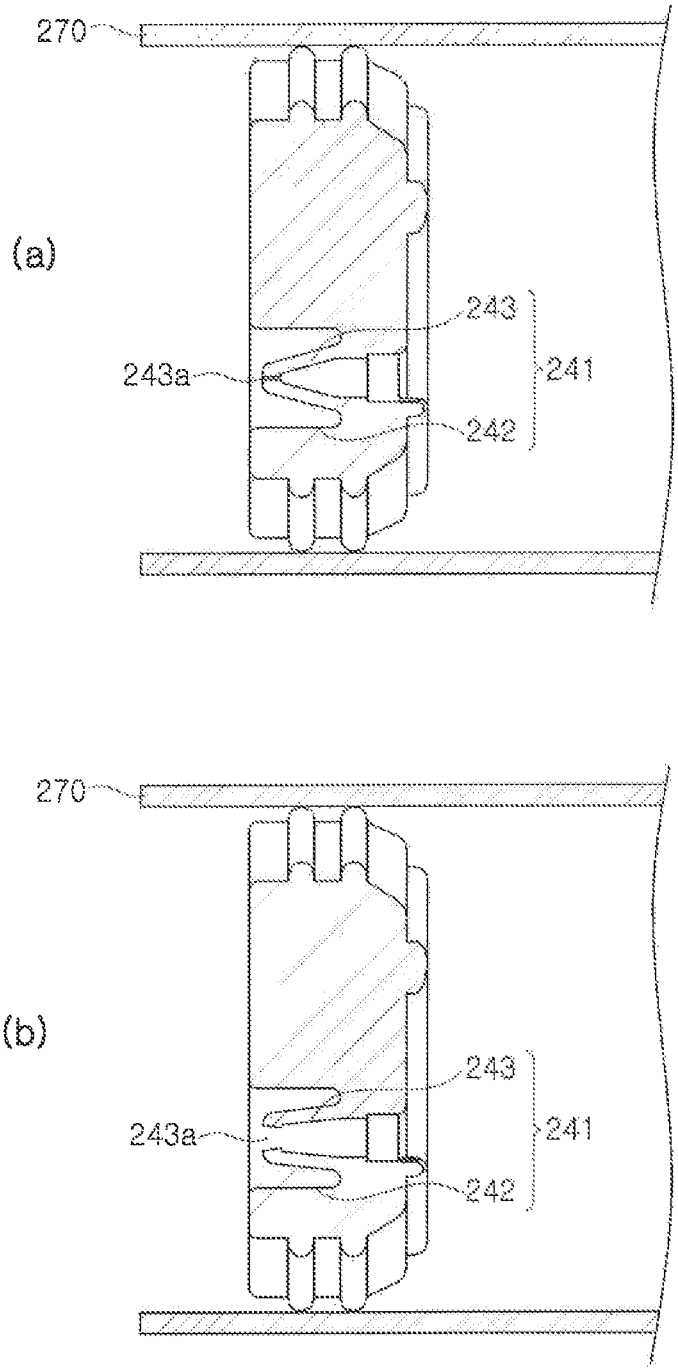

[FIG.10]
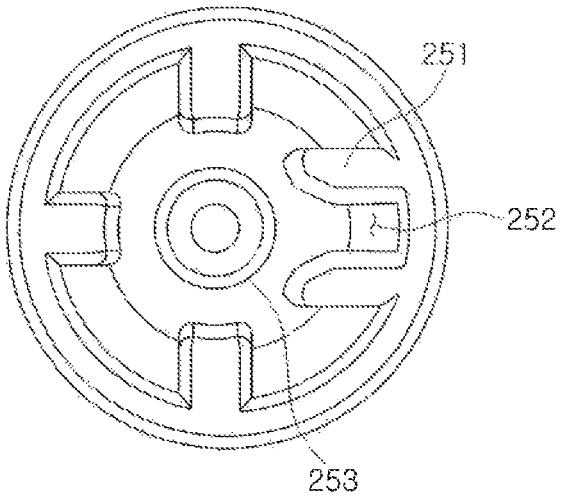

LAMP MODULE AND BIDET DEVICE INCLUDING SAME

CROSS REFERENCE TO RELATED APPLICATIONS

This application is the U.S. National Stage entry of International Application Number PCT/KR2016/011731 filed under the Patent Cooperation Treaty having a filing date of Oct. 19, 2016, which claims priority to Korean Patent Application Serial Number 10-2015-0154557 having a filing date of Nov. 4, 2015, which are incorporated herein by reference.

BACKGROUND

1. Field

The present disclosure relates to a lamp module and a bidet device including the same.

2. Description of Related Art

Heat therapy devices generally radiate heat (or warmth) via infrared rays to a local area of a user to perform a heating function. Recently, due to the effect of blood circulation improvement, or the like, of heat therapy devices, users of heat therapy devices have increased.

In particular, heat therapy performed after a treatment or an operation for anal diseases, postpartum lesions, or the like, has an effect of reducing pain and increasing blood circulation to shorten a recovery time.

Thus, in recent years, bidet devices have tended to have a heat therapy function so that heat therapy may easily be performed on users' buttocks.

As part of heat therapy devices provided in bidet devices, a heat therapy device using a lamp is used.

However, in the case of the heat therapy device using a lamp, internal air expands due to an increase in an internal temperature of a lamp module to repeatedly apply an external force to a cover glass covering the lamp, resulting in reduced durability.

Also, ambient moisture may penetrate into the lamp module to cause malfunctions.

Thus, research into a lamp module in which durability of a cover glass is improved and ambient moisture penetration is prevented is required.

SUMMARY

An aspect of the present disclosure may provide a lamp module having improved durability and moisture-proof performance.

According to an aspect of the present disclosure, a lamp module may include: a lamp having electrode terminals at opposing ends; a bracket part including first and second brackets coupled to the opposing ends of the lamp to support the electrode terminals; and a cover glass allowing the lamp and the bracket part to be inserted into and coupled to the cover glass and having a hollow such that one surface of the first bracket is exposed externally, wherein a communication portion allowing the internal and external portions of the cover glass to communicate with each other is provided in the first bracket.

The communication portion may include a side wall portion led inwardly from one surface of the first bracket and an opening and closing portion protruding toward one surface of the first bracket from a lower portion of the sidewall portion and having a slit at an end portion.

The slit may be opened when air inside the cover glass expands.

An end portion of the opening and closing portion may be provided to be lower than one surface of the first bracket.

The opening and closing portion may be sloped such that an internal sectional area decreases toward one side of the first bracket from a lower portion of the side wall portion.

A coupling hole through which the electrode terminal of the lamp passes may be provided in the first bracket.

An electric wire passage hole may be provided in the first bracket.

A support partition may protrude from an inner surface of the second bracket to support the electrode terminals of the lamp.

The support partition may be provided in plural, the plurality of support partitions may be spaced apart from each other, and an electric wire arrangement space may be provided between the plurality of support partitions.

The lamp module may further include a cap member coupled to one open end of the cover glass.

The lamp module may further include: a guide part to which the cap member is coupled; a driving part coupled to one side of the guide portion and slidably moving the cap member; and a cleaning part coupled to the other side of the guide part and having a guide hole through which the cover glass passes.

The cleaning part may include a cleaning connector connected to external raw water and spraying washing water onto an outer surface of the cover glass.

According to another aspect of the present disclosure, a bidet device may include: a main body having an internal space; a lamp module provided to be slidably movable forwards and backwards in the internal space according to an exemplary embodiment in the present disclosure; a nozzle assembly spaced apart from the lamp module in the internal space and spraying cleaning water; and an operating part coupled to one side of the main body and controlling the lamp module and the nozzle assembly.

BRIEF DESCRIPTION OF DRAWINGS

The above and other aspects, features and other advantages of the present disclosure will be more clearly understood from the following detailed description taken in conjunction with the accompanying drawings, in which:

FIGS. 1*a* and 1*b* are schematic cross-sectional views of a bidet device according to an exemplary embodiment in the present disclosure;

FIG. 2*a* is a perspective view of a lamp module according to an exemplary embodiment in the present disclosure, and FIG. 2*b* is a bottom perspective view of a lamp module according to an exemplary embodiment in the present disclosure;

FIG. 3 is an enlarged view of a lamp part according to an exemplary embodiment in the present disclosure;

FIG. 4 is an exploded perspective view of a lamp part according to an exemplary embodiment in the present disclosure;

FIG. 5 is an exploded perspective view illustrating a coupling relationship between a lamp and a bracket part in a lamp part according to an exemplary embodiment in the present disclosure;

FIGS. 6*a* and 6*b* are a cross-sectional perspective view and a cross-sectional view taken along line A-A' of FIG. 3, respectively;

FIG. 7*a* is an enlarged view of a first bracket according to an exemplary embodiment in the present disclosure and FIG. 7*b* is a cross-sectional perspective view taken along line B-B' of FIG. 7*a;*

FIG. 8 is a plan view of a first bracket according to an exemplary embodiment in the present disclosure;

FIGS. 9*a* and 9*b* is a schematic operation diagram of a first bracket according to an exemplary embodiment in the present disclosure; and FIG. 10 is a plan view of a second bracket according to an exemplary embodiment in the present disclosure.

DETAILED DESCRIPTION

Exemplary embodiments of the present disclosure will now be described in detail with reference to the accompanying drawings.

FIGS. 1A and 1B are schematic cross-sectional views of a bidet device 1000 according to an exemplary embodiment in the present disclosure. Referring to FIGS. 1 and 2, the bidet device 1000 includes a main body 100, a lamp module 200, a nozzle assembly 140, and an operating part 130.

The main body 100, a member fixed to and mounted on an upper portion of a toilet seat, includes an internal space, and various components required for realizing a function of the bidet device 1000, such as the lamp module 200, the nozzle assembly 140, a drying device 150, and the like, may be provided in the internal space.

The nozzle assembly 140 may be spaced apart from the lamp module 200 by a predetermined distance and may be slidably movable forwards and backwards in the main body 100. The nozzle assembly 140 may be moved forwards to spray cleaning water onto a local area of a user. The drying device 150 may be operated to serve to dry the local area of the user after the nozzle assembly 140 is driven.

In the bidet device 1000, the nozzle assembly 140 and the drying device 150 are general components, and thus a detailed description thereof will be omitted.

A seat plate 120 may be rotatably hinged to the main body 120. The user may position the seat plate 120 on the toilet seat or lift it up from the seat to use as necessary.

The operating part 130 may be coupled to one side of the main body 100 to control the nozzle assembly 140, the drying device 150, the lamp module 200 (to be described hereinafter), and the like. The operating part 130 may be provided with a plurality of buttons, and the user may control an operation (or driving) of the bidet device 1000 by pressing a button of the operating part 130 as necessary.

Hereinafter, a detailed structure of the lamp module 200 provided in the main body 100 will be described.

FIG. 2A is a perspective view of the lamp module 200 according to an exemplary embodiment in the present disclosure and FIG. 2B is a bottom perspective view of the lamp module 200 according to an exemplary embodiment in the present disclosure. Referring to FIGS. 2A and 2B, the lamp module 200 may include a lamp part 201, a guide part 281, a driving part 282, and a cleaning part 283.

The guide part 281 may be fixedly mounted in an internal space of the main body 100 and the lamp part 201 may be slidably coupled to the guide part 261. For example, a cap member 280 of the lamp part 201 may be slidably coupled to the guide part 281.

The driving part 282 may be coupled to one side of the guide part 281 and may be connected to a cap member 280 of the lamp part 201 by a cable, or the like. Here, when the driving part 282 is driven, the cable may be wound around or drawn out to the driving part 282. Thus, the lamp part 201 may slidably move back and forth through the medium of the cable. The driving part 282 may be a motor, for example.

Meanwhile, the cleaning part 283 may be provided on the other side of the guide part 281. The cleaning part 283 has a guide hole 283*a* through which a cover glass 270 of the lamp part 201 passes. The cover glass 270 may pass through the guide hole 283*a* when slidably moved.

The cleaning part 283 may have a cleaning connector 283*b* connected to external raw water and spraying washing water onto an outer surface of the cover glass 270.

Since the cover glass 270 moves externally of the main body 100, there is a possibility that the cover glass 270 may be stained with a foreign object. Thus, when the cover glass 270 moves backwards, the cleaning connector 283*b* may spray washing water onto the outer surface of the cover glass 270 to maintain cleanliness.

FIG. 3 is an enlarged view of the lamp part 201 according to an exemplary embodiment in the present disclosure, FIG. 4 is an exploded perspective view of the lamp part 201 according to an exemplary embodiment in the present disclosure, FIG. 5 is an exploded perspective view illustrating a coupling relationship between the lamp 210 and a bracket part in the lamp part 210 according to an exemplary embodiment in the present disclosure, and FIGS. 6A and 63B are a cross-sectional perspective view and a cross-sectional view taken along line A-A' of FIG. 3, respectively.

Referring to FIGS. 3 to 6, the lamp part 201 provided in the lamp module 200 according to an exemplary embodiment in the present disclosure includes a lamp 210, a bracket part 230, the cover glass 270, and the cap member 280.

The lamp 210 may be provided to radiate heat and infrared rays to a local portion of the user and include electrode terminals 211 to receive electric power at opposing ends thereof.

The bracket part 230 may be coupled to opposing ends of the lamp 210 to support the electrode terminals 211. For example, the bracket part 230 may include a first bracket 240 coupled to the electrode terminal 211 and exposed externally in one surface thereof when coupled to the cover glass 270 and a second bracket 250 coupled to the electrode terminal 211 and disposed inside the cover glass 270 when coupled to the cover glass 270.

With reference to FIG. 4, the first bracket 240 is coupled to the electrode terminal 211 provided in an upper portion of the lamp 210, and the second bracket 250 is coupled to the electrode terminal 211 provided in a lower portion of the lamp 210. Here, the upper and lower portions are based on the drawings and may be expressed differently when a direction of the object is changed.

The bracket part 230 may be provided to easily arrange electric wires connected to the electrode terminals 211 of the lamp 210, as well as supporting the lamp 210 inside the cover glass 270. Details of the bracket part 230 will be described later.

The lamp 210 may be inserted into the cover glass 270 in a state in which the bracket parts 230 are coupled to opposing ends of the lamp 210. To this end, the cover glass 270 may include a hollow 270*a*.

When the lamp 210 is inserted into the cover glass 270, one surface of the first bracket 240 may be exposed externally and the second bracket 250 may be disposed inside the cover glass 270.

An outer circumferential surface of the first bracket 240 may be in contact with an inner circumferential surface of the cover glass 270 to support the lamp 210, and an outer circumferential surface of the second bracket 250 may be spaced apart from an inner circumferential surface of the cover glass 270 at a predetermined interval. Here, a packing member 244 may be provided below the first bracket 240 to prevent moisture from penetrating between the outer circumferential surface of the first bracket 240 and the inner circumferential surface of the cover glass 270.

The cap member 280 may be coupled to one end of the cover glass 270 that is open. The cap member 280 is slidably coupled to the guide part 281 described above. Accordingly, the lamp part 201 may be slidably coupled to the guide part 281 by the medium of the cap member 280.

An electric wire (not shown) connected to an external power source (not shown) to supply power may be coupled to the electrode terminals 211 of the lamp 210.

The electric wire may be coupled to each of the electrode terminals 211 provided at opposing ends of the lamp 210. Here, the first bracket 240 includes a coupling hole 240*a* through which the electrode terminal 211 passes to be coupled. Therefore, in the case of the electrode terminal 211 coupled to the first bracket 240, the electric wire may be connected to the electrode terminal 211 penetrating through the first bracket 240 and drawn out to an electric wire lead hole 280*a* of the cap member 280.

The electric wire coupled to the electrode terminal 211 coupled to the second bracket 250 is first drawn out in a direction in which the first bracket 240 is provided through an electric wire arrangement space 252 provided between the second bracket 250 and electrode terminal 211 and finally drawn out to the electric wire lead hole 280*a* through an electric wire passage hole 240*b* of the first bracket 240.

Since the second bracket 250 includes the electric wire arrangement space 252 and the first bracket 240 includes the electric wire passage hole 240*b* as described above, the lamp module 200 according to an exemplary embodiment in the present disclosure facilitates organization of the electric wire.

FIG. 7A is an enlarged view of the first bracket according to an exemplary embodiment in the present disclosure, FIG. 7B is a cross-sectional perspective view taken along line B-B' of FIG. 7A, FIG. 8 is a plan view of the first bracket according to an exemplary embodiment in the present disclosure, FIG. 9 is a schematic operation diagram of the first bracket according to an exemplary embodiment in the present disclosure.

Hereinafter, a detailed structure of the first bracket 240 provided in the lamp module 200 according to an exemplary embodiment in the present disclosure will be described with reference to FIGS. 7 to 8.

The first bracket 240 may include a coupling hole 240*a* through which the electrode terminal 211 of the lamp 210 is inserted and coupled. The electrode terminal 211 may be inserted into the coupling hole 240*a* and partially exposed externally.

Also, the first bracket 240 may include the electric wire passage hole 240*b*. The electric wire coupled to the electrode terminal 211 coupled to the second bracket 240 may be drawn out to the electric wire lead hole 280*a* (see FIG. 6) through the electric wire passage hole 240*b*.

The first bracket 240 may include a communication portion 241 allowing the inside and the outside of the cover glass 270 to communicate with each other.

For example, the communication portion 241 may include a side wall portion 242 led inwardly from one surface of the first bracket 240 and an opening and closing portion 243 protruding toward one surface of the first bracket 240 from a lower portion of the side wall portion 242 and having a slit at an end portion thereof.

Here, the opening and closing portion 243 may be sloped such that an internal sectional area thereof decreases toward one side of the first bracket 240 from a lower portion of the side wall portion 242. For example, a diameter L of the internal cross-section of the opening and closing portion 243 may decrease from the lower portion of the side wall portion 242 toward an upper portion.

The end of the opening and closing portion 243 may be lower than one surface of the first bracket 240 to prevent the first bracket 240 from being damaged when the first bracket 240 is assembled.

Meanwhile, air inside the cover glass 270 may be discharged externally through the slit 243*a*. Hereinafter, a process in which the inside air of the cover glass 270 is discharged externally through the slit 243*a* will be briefly described with reference to FIG. 9.

FIG. 9A illustrates a state of the first bracket 240 before the operation of the lamp module, that is, before the air inside the cover glass 270 is heated.

Referring to FIG. 9, before the internal air of the cover glass 270 is heated, the slits 243*a* are held in close contact with each other or at a very small interval.

FIG. 9B illustrates a state of the first bracket 240 after the operation of the lamp module, in other words, when the internal air of the cover glass 270 is heated by the lamp.

When the internal air of the cover glass 270 is heated, the opening and closing portion 243 is subjected to air pressure due to air expansion, whereby a space of the slit 243*a* widens and the slit 243*a* is opened. The heated air inside the cover glass 270 is discharged externally through the opened interval.

As a result, by discharging the heated internal air through the communication portion 241 externally, an external force applied to the cover glass 270 by the air expansion may be reduced and durability of the cover glass 270 may be improved.

FIG. 10 is a plan view of the second bracket 250 according to an exemplary embodiment in the present disclosure. Referring to FIG. 10, a support partition 251 may protrude from an inner surface of the second bracket 250 to support the electrode terminal 211 (see FIG. 6) of the lamp 210 (see FIG. 6). Here, a plurality of the supporting partitions 251 may be provided and spaced apart from each other, so that the electric wire arrangement space 252 may be provided between the supporting partitions 251.

Further, a space maintaining portion 253 may protrude from an internal bottom surface of the second bracket 250. That is, the electric wire arrangement space 252 may be provided between the inner surface of the second bracket 250 and the electrode terminal 211 by means of the support partition 251 and the space maintaining portion 253. Accordingly, the electric wire connected to the electrode terminal 211 coupled to the second bracket 250 may be drawn out in a direction in which the first bracket 240 is provided through the electric wire arrangement space 252 and finally drawn out through the electric wire passage hole 240*b* provided in the first bracket 240. Therefore, the electric wire connected to the lamp 210 may be easily organized.

As set forth above, according to exemplary embodiments of the present disclosure, durability and moisture-proof performance of the lamp module may be improved.

While exemplary embodiments have been shown and described above, it will be apparent to those skilled in the art that modifications and variations could be made without departing from the scope of the present disclosure as defined by the appended claims.

What is claimed is:

1. A lamp module comprising:

a lamp having electrode terminals at opposing ends;

a bracket part including first and second brackets coupled to the opposing ends of the lamp to support the electrode terminals; and a cover glass allowing the lamp and the bracket part to be inserted into and coupled to the cover glass and having a hollow such that one surface of the first bracket is exposed externally, wherein a communication portion allowing the internal and external portions of the cover glass to communicate with each other is provided in the first bracket;

wherein the communication portion includes a side wall portion led inwardly from one surface of the first bracket and an opening and closing portion protruding toward one surface of the first bracket from a lower portion of the side wall portion and having a slit at an end portion; and wherein the slit is opened when air inside the cover glass expands.

2. The lamp module of claim 1, wherein an end portion of the opening and closing portion is provided to be lower than one surface of the first bracket.

3. The lamp module of claim 1, wherein the opening and closing portion is sloped such that an internal sectional area decreases toward one side of the first bracket from a lower portion of the side wall portion.

4. The lamp module of claim 1, wherein a coupling hole through which the electrode terminal of the lamp passes is provided in the first bracket.

5. The lamp module of claim 1, wherein an electric wire passage hole is provided in the first bracket.

6. The lamp module of claim 1, wherein a support partition protrudes from an inner surface of the second bracket to support the electrode terminals of the lamp.

7. The lamp module of claim 6, wherein the support partition is provided in plural, the plurality of support partitions are spaced apart from each other, and an electric wire arrangement space is provided between the plurality of support partitions.

8. The lamp module of claim 1, further comprising a cap member coupled to one open end of the cover glass.

9. The lamp module of claim 8, further comprising:

a guide part to which the cap member is coupled;

a driving part coupled to one side of the guide portion and slidably moving the cap member; and a cleaning part coupled to the other side of the guide part and having a guide hole through which the cover glass passes.

10. The lamp module of claim 9, wherein the cleaning part includes a cleaning connector connected to external raw water and spraying washing water onto an outer surface of the cover glass.

11. A bidet device comprising:

a main body having an internal space;

a lamp module provided to be slidably movable forwards and backwards in the internal space, according to claim 1;

a nozzle assembly spaced apart from the lamp module in the internal space and spraying cleaning water; and an operating part coupled to one side of the main body and controlling the lamp module and the nozzle assembly.

* * * * *